United States Patent [19]

Grazen

[11] Patent Number: 4,737,162

[45] Date of Patent: Apr. 12, 1988

[54] METHOD OF PRODUCING ELECTRO-FORMED ABRASIVE TOOLS

[76] Inventor: Alfred Grazen, Box 78K Merriwold L, Essex, Conn. 06426

[21] Appl. No.: 895,689

[22] Filed: Aug. 12, 1986

[51] Int. Cl.[4] ..... B24D 3/00

[52] U.S. Cl. ..... 51/293; 51/309; 204/4

[58] Field of Search ..... 51/293, 309; 204/4

[56] References Cited

U.S. PATENT DOCUMENTS

| | | | |
|---|---|---|---|
| 2,505,196 | 4/1950 | Mays | 51/309 |
| 2,820,746 | 1/1958 | Keeleric | 51/309 |
| 3,517,464 | 6/1970 | Mattia et al. | 51/293 |
| 3,694,177 | 9/1972 | Vereschagin et al. | 51/293 |
| 3,762,895 | 10/1973 | Keeleric | 51/293 |
| 3,785,938 | 1/1974 | Sam | 51/309 |
| 4,211,294 | 7/1980 | Multakh | 51/309 |
| 4,373,933 | 2/1983 | Grazen | 51/309 |

*Primary Examiner*—Paul Lieberman
*Assistant Examiner*—Willie J. Thompson
*Attorney, Agent, or Firm*—Fishman & Dionne

[57] ABSTRACT

A method of producing precision abrasive articles by electroforming for use in metal removal operations. In this method abrasive particles are packed firm between the inner circumferential surface of a mold and a centrally located metallic grid. Electrolyte for metal deposition is then introduced into the space containing the abrasive particles. An electrical cathode connection is made to the mold and an anodic connection made to the anode. Metallic deposition around the abrasive articles occurs on the inner annular surface of the mold and continues until a matrix supporting the abrasive particles is formed. The mold with the matric is then removed to receive core material, and the core is then machined to finished dimensions. The method is carried out at low temperatures and without any movement of the mold.

20 Claims, 1 Drawing Sheet

METHOD OF PRODUCING ELECTRO-FORMED ABRASIVE TOOLS

This invention relates to a method of producing electro-formed abrasive tools. Although this method can be used with abrasives such as diamonds, silicons, oxides, carbides, nitrides or other hard particles, this specification shall be used with diamonds in the preferred embodiment of the invention.

Diamond dressing rolls have been produced for many years by prior art that requires hand setting of diamonds onto a machined mold and then sintering in a nickel, silver and tungsten alloy at temperatures of 2000° F. This alloy provides a matrix for the diamond particles and a hub or core for mounting the roll onto the diamond dresser spindle. This procedure is time consuming, and the high temperature of sintering causes distortion which must be subsequently corrected by grinding and lapping of the diamond surfaces. Such grinding and lapping results in the loss of free cutting diamond points and creates a dull surface which effects a certain amount of crush dressing. This causes higher spindle deflection, vibration and horsepower requirements. The degree of crush dressing effected is proportioned to the amount of surface area represented by the diamond particles which are ground or lapped to a face geometry which conforms to the dresser roll surface. Further, the relatively high temperature of sintering also aggravates diamond flaws and may cause rupture and premature erosion. U.S. Pat. No 4,373,933 was granted to me on Feb. 15, 1983, entitled Method of producing Precision Abrasive Tools. The method disclosed in the aforesaid patent overcame the use of high temperatures, by utilizing rotating a mold containing abrasive particles and electrolytic solution to electroform the abrasive portion of the article. The drawback of the method in U.S. Pat. No. 4,373,933 was the need to rotate a mass consisting of a mold, abrasive particles and electrolytic solution.

It is an object of this invention to provide a lower temperature method of producing abrasive tools.

Another object of this invention is to provide an economical process with no rotation requirements for producing abrasive tools at low temperatures.

A more specific object of this invention is to provide a simple and economic method of producing high precision diamond abrasive tools in a stationary mold.

With this and other objects in view as will hereinafter become apparent, the method of my invention is described herein in the production of a high precision diamond abrasive tool. In making this tool, an annular mold is formed whose internal circumferential surface has the precise geometry of the tool's circumference. The annular mold is affixed horizontally to a base plate and a cylindrical fine wire mesh is inserted into the open central portion of the mold and is equidistantly spaced from the internal surface of the mold. Abrasive diamond particles are packed into the annular space formed by the internal surface of the mold and the fine wire mesh. A top fixture plate is affixed to the mold. An elecrolytic solution for metal deposition is introduced to the annular space containing the abrasive particles filling this whole space. The mold surface has a cathode connection, and the fine wire mesh has an anode connection. Metal deposition occurs on the mold surface enveloping the abrasive particles and forming a matrix of metal with imbedded diamond particles on the mold surface. The metal in the electrolytic solution can be selected from the group consisting of nickel, copper, iron, tin and silver. For the purpose of economy, the electro-deposition is stopped after a predetermined time, and the top plate is removed so that excess diamond particles may be removed. The top plate is again secured and electro-deposition resumed until a matrix of sufficient thickness is formed which is structurally sound. When this is achieved, the electro-deposition is stopped and the metallic grid is removed and the matrix is separated from the mold. The material is then introduced into the matrix. The core material can be plastic or ceramic which hardens at room temperature. When the core material solidifies, the sides of the matrix and core are machined and a hole is drilled, thus finishing the diamond abrasive tool. The temperatures of the electrolyte and electro-deposition may range from room temperature up to 200° F. After removal of the matrix from the mold, a certain amount of matrix material is etched away slightly to expose more fully the diamond particle cutting edges.

Other features and many of the attendant advantages of this invention will be readily appreciated as the invention becomes better understood from the following description taken in connection with the illustrative embodiments in the accompanying drawings wherein.

Figure 1:
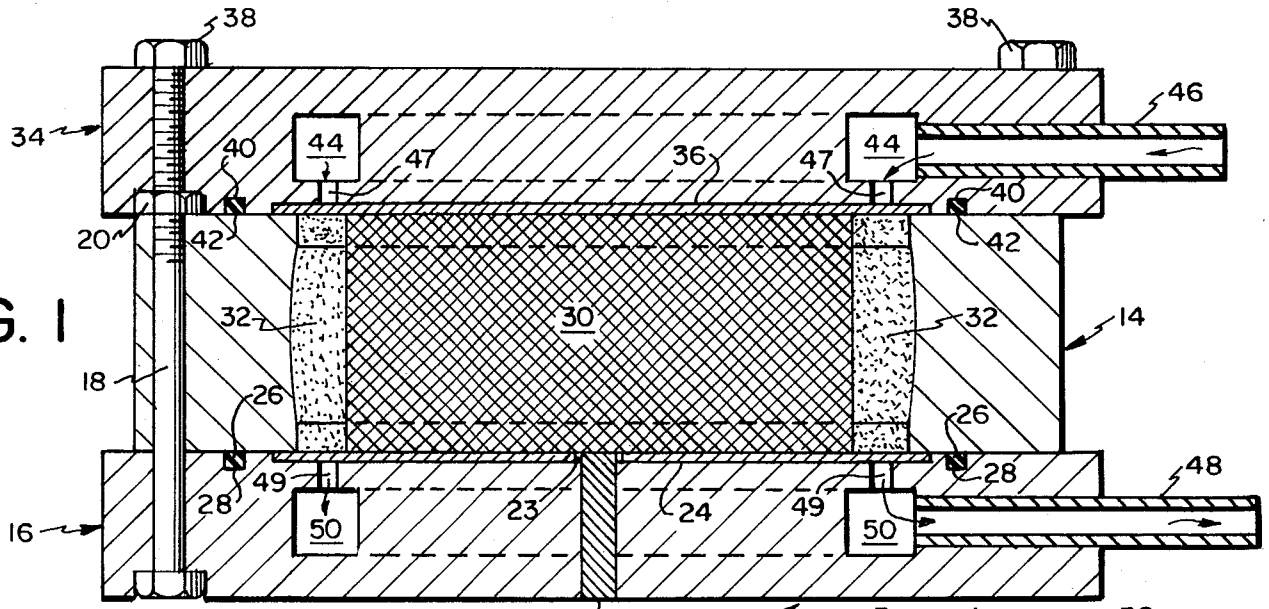
FIG. 1 illustrates the mold and fixture assembly used in the described method.

Referring now to the drawings and initially to FIG. 1, there is the mold fixture assembly 10 for making the abrasive tool, which in our case is a cylindrical dressing tool 12. The annular mold 14 can be made of various materials, as shown here it is made of aluminum. The mold 14 is placed horizontally on base plate 16 and bolted to the base plate by four bolts 18, only one is shown, and nuts 20. A fine screen 22 is centrally located on and flush with the top of base plate 16, which has a recess 24 to receive the fine screen 22. There is an insulated central opening 23 in screen 22. An O ring 26 is seated in groove 28 to seal the face between the mold 14 and base plate 16. A cylindrically shaped fine wire mesh 30 is placed inside mold 14 and rests on fine screen 22. The height of the mesh 30 reaches the top of mold 14. The distance between the wire mesh 30 and the internal surface of mold 14 is equal around the circumference of the mold 14. A top plate 34 with a fine screen 36 is placed on top of mold 14 and fine wire mesh 30 and bolted together on the same stems of bolts 18 by nuts 38. An O ring 40 is seated in groove 42 to seal the face between mold 14 and top plate 34. Top plate 34 has an internal annular chamber 44 which receives electrolyte pumped from a reservoir, not shown, through inlet pipe 46. Feeder lines 47 lead from chamber 44 onto screen 36 into the space between the wire mesh 30 and the internal surface of mold 14. Base plate 16 has similar internal passages to return the electrolyte to a sump, not shown, through outlet pipe 48. The internal passages consist of lines 49 connecting into the lower annular chamber 50 which feeds the electrolyte to outlet pipe 48. An anode contact 52 is centrally located in the base plate 16 and makes contact with wire mesh 30. The wire mesh 30 through anode contact 52 receives a positive charge from a source not shown. Mold 14 receives a negative charge from a source not shown. Anode contact 52 passes through the insulated central openings 23 of fine screen 22.

Figure 2:
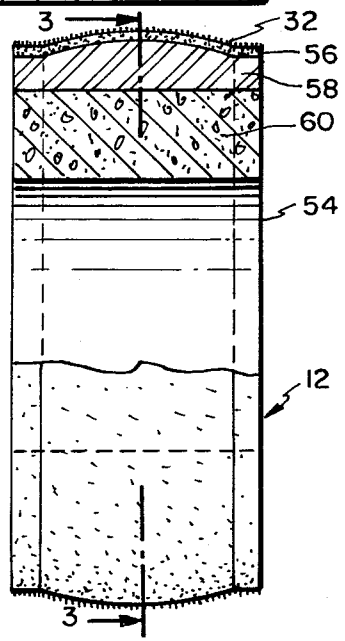
FIG. 2 shows an end view of the finished abrasive tool with a break away portion.

The method of making the abrasive wheel tool 54 shown in FIG. 2 is as follows:

In assembling the mold fixture assembly 10, after mold 14 has been fastened to face plate 16 and fine wire mesh 30 has been placed in the central opening of the mold 14, diamond particles 32 are packed into the space between the mold 14 internal surface and wire mesh 30. It should be noted that the wire mesh 30 must be fine enough to prohibit any diamond particles 32 from passing through it. The top plate 34 is then fastened to the mold 14 by bolts 38 as previously described. Mold 14 receives a negative charge and wire mesh 30 receives a positive charge. Electrolyte for metal deposition is then fed into inlet pipe 46 through internal passages 44 and 47 into the space occupied by diamond particles 32. The input rate of electrolyte is slightly higher than the exhaust rate to maintain a positive pressure in the space packed with diamond particles 32. Electro-deposition of metal begins to take place onto the internal surface of mold 14. As metallic deposition is continued, the diamond particles 32 in contact with the mold 14 internal surface is enclosed by the metal being electro-deposited. After a predetermined period when the desired amount of diamond particles 32 are enclosed by a matrix 58 formed by the metal deposited, electro-deposition is stopped. The top plate 34 is then removed, and the excess diamond particles 32 are also removed. Although a diamond section 56 of only one layer of diamond particles on the mold 14 internal surface is needed for economic reasons, additional layers may be deposited to form a thicker diamond section 56. Once the desired diamond section 56 is obtained, it can be backed up with additional metallic electrolytic deposition to thicken matrix 58. This matrix 58 buildup can be continued to make up the entire core structure or can be stopped and core materials 60 such as plastics, adhesives, ceramics or other material can be mechanically added to backup matrix 58. The mold 14, with deposited material is removed from the assembly, and the core is machined to size and the axial portion is drilled to the desired size.

Figure 3:
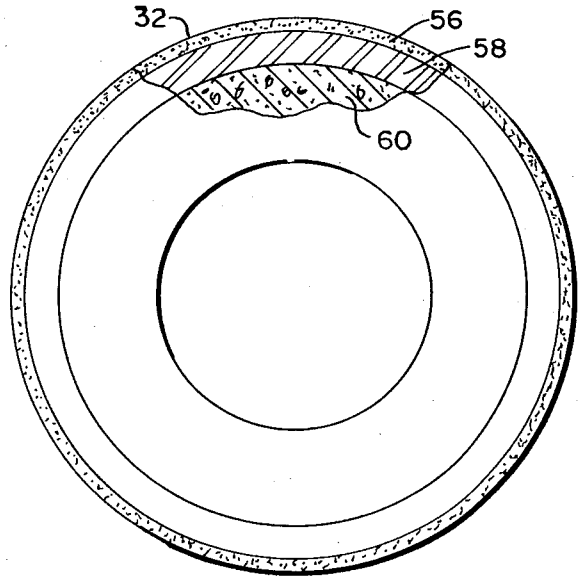
FIG. 3 shows a section through the finised abrasive wheel.

The mold 14 is then removed either by mechanical means of grinding or by chemical means by dissolution in acid or alkali solutions. In our preferred embodiment of using an aluminum mold, this can be chemically expended by dissolution in a caustic solution. The composition of the abrasive tool 54 is best seen in FIG. 2 and FIG. 3.

Once the mold 14 is removed, one may wish to better expose the cutting edges of the diamond particles. This can be achieved by etching away a portion of the diamond section 56 either chemically or electrochemically with acids or alkalis. In the preferred embodiment, the metallic portion of section 56 can be etched away with nitric acid or aqua regia. The cutting edges of diamond particles 22 may also be exposed by a blasting operation where the abrasive material such as sand, silicon carbide or aluminum oxide is used.

Having thus described my invention and advantages thereof, it will be understood that the foregoing disclosure relates not only to preferred embodiments of the invention, but it is also intended to cover all changes and modifications of the invention selected for the purpose of disclosure without departing from the true spirit and scope thereof.

I claim:

1. A method of making an abrasive tool consisting essentially of the steps of:

(a) forming an annular space between the inner circumferential surface of a stationary mold and a centrally located metallic cylinder being comprised of a wire mesh, (b) packing diamond particles in the annular space between said stationary mold and metallic cylinder in an amount which is in excess of the number of particles needed to cover the inner circumferential surface of said mold, (c) sealing said stationary mold, metallic cylinder and diamond particle packed space against leakage, (d) introducing an electrolytic solution into the annular space between said mold and metallic cylinder, (1) wherein the mold has a negative charge forming a cathode, (2) wherein the metallic cylinder has a positive charge forming an anode, (e) forming a solidified matrix of metal by electrolytic deposition around the diamond particles on the inner circumferential surface of said stationary mold, (f) removing the diamond particles which are not contained within the matrix, (g) continuing the buildup of the matrix to the desired thickness by electrolytic deposition, (h) introducing core material into said mold as a backup for said matrix, (i) machining the core material to desired dimensions, (j) separating the mold from said matrix with the diamond particles and core material.

2. A method set forth in claim 1 wherein the metal in the electrolytic solution is selected from the group consisting of nickel, copper, iron, tin or silver, chrome or alloys of nickel such as tin nickel or nickel cobalt.

3. A method set forth in claim 1 wherein the metallic cylinder is made up of fine wire mesh of suitable anode material, such as nickel or platinum for a nickel electrolyte.

4. A method as set forth in claim 1 wherein the temperature of the electrolytic deposition may range from room temperature to 200° F.

5. A method as set forth in claim 1 wherein the core material is a plastic or ceramic which hardens at room temperature.

6. A method as set forth in claim 1 wherein the mold is separated from the matrix by means of chemical dissolution in an acid or alkali solution.

7. A method as set forth in claim 1 wherein the surface of the matrix, having the diamond particles, after the matrix has been separated from the mold is etched to further expose the cutting edges of the diamond particles.

8. A method as set forth in claim 7 wherein the etching is performed chemically with acids or alkalis.

9. A method as set forth in claim 1 wherien the electrolytic solution is introduced under pressure into said annular space.

10. A method of making an abrasive tool consisting essentially of the steps of:

(a) packing abrasive particles in an annular space formed by the inner circumferential surface of a stationary mold and a centrally located metallic cylinder being comprised of a wire mesh, (b) introducing an electrolytic solution into the annular space between said mold and metallic cylinder, (1) wherein the mold has a negative charge forming a cathode, (2) wherein the metallic cylinder has a positive charge forming an anode, (c) forming a solidified matrix of metal by electrolytic deposition around the abrasive particles on the inner circumferential surface of said stationary mold, (d) removing the abrasive particles which are not contained within said matrix, (e) continuing the buildup of the matrix to the desired thickness by electrolytic deposition, (f) introducing core material into said mold as a backup for said matrix, (g) machining the core material to the desired dimensions, (h) separating the mold from said matrix with the abrasive particles and core material.

11. A method of making an abrasive tool, which comprises:

(a) forming an annular space between the inner circumferential surface of a stationary mold and a centrally located metallic cylinder being comprised of a wire mesh (b) packing diamond particles in the annular space between said stationary mold and metallic cylinder in an amount which is in excess of the number of particles need to cover the inner circumferential surface of said stationary mold, (c) sealing said stationary mold, metallic cylinder and diamond particles packed space against leakage, (d) introducing an electrolytic solution into the annular space between said stationary mold and metallic cylinder, (1) wherein the stationary mold has a negative charge forming a cathode, (2) wherein the metallic cylinder has a positive charge forming an anode, (e) forming a solidified matrix of metal by electrolytic deposition around the diamond particles on the inner circumferential surface of said stationary mold, (f) removing the diamond particles which are not contained within said matrix, (f) continuing the buildup of the matrix to the desired thickness by electrolytic deposition, (h) introducing core material into said stationary mold as a backup for said matrix, (i) machining the core material to desired dimensions, (j) separating the stationary mold from said matrix with the diamond particles and core material.

12. A method set forth in claim 11 wherein the metal in the electrolytic solution is selected from the group consisting of nickel, copper, iron, tin or silver, chrome or alloys of nickel such as tin nickel or nickel cobalt.

13. A method set forth in claim 11 wherein the metallic cylinder is made up of fine wire mesh of suitable anode material, such as nickel or platinum for a nickel electrolyte.

14. A method as set forth in claim 11 wherein the temperature of the electrolytic deposition may range from room temperature to 200° F.

15. A method as set forth in claim 11 wherein the core material is a plastic or ceramic which hardens at rom temperature.

16. A method as set forth in claim 11 wherein the stationary mold is separated from the matrix by means of chemical dissolution in an acid or alkali solution.

17. A method as set forth in claim 11 wherein the surface of the matrix, having the diamond particles, after the matrix has been separated from the stationary mold is etched to further expose the cutting edges of the diamond particles.

18. A method as set forth in claim 17 wherein the etching is performed chemically with acids or alkalis.

19. A method as set forth in claim 17 wherein the electrolytic solution is introduced under pressure into said annular space.

20. A method of making an abrasive tool, which comprises:

(a) packing abrasive particles in an annular space formed by the inner circumferential surface of a stationary mold and a centrally located metallic cylinder being comprised of a wire mesh, (b) introducing an electrolytic solution into the annular space between said stationary mold and metallic cylinder, (1) wherein the stationary mold has a negative charge forming a cathode, (2) wherein the metallic cylinder has a positive charge forming an anode, (c) forming a solidified matrix of metal by electrolytic deposition around the abrasive particles on the inner circumferential surface of said stationary mold, (d) removing the abrasive particles which are not contained within said matrix, (e) continuing the buildup of the matrix to the desired thickness by electrolytic deposition, (f) introducing core material into said stationary mold as a backup for said matrix, (g) machining the core material to the desired dimensions, (h) separating the stationary mold from said matrix with the abrasive particles and core material.

* * * * *